US005802737A

United States Patent [19]

Beppu

[11] Patent Number: 5,802,737

[45] Date of Patent: Sep. 8, 1998

[54] THONG TYPE SANDAL

[76] Inventor: Shinichi Beppu, Haimu-Shirogane-101 1-7-3 Kamiousaki, Shinagawa-ku Tokyo, Japan

[21] Appl. No.: 816,215

[22] Filed: Mar. 12, 1997

[51] Int. Cl.[6] ..... A43B 3/12

[52] U.S. Cl. ..... 36/11.5; 36/94

[58] Field of Search ..... 36/11.5, 94, 8.1

[56] References Cited

U.S. PATENT DOCUMENTS

| | | | |
|---|---|---|---|
| 1,213,030 | 1/1917 | Skinner | 36/11.5 |
| 1,867,679 | 7/1932 | Riehle et al. | 36/11.5 |
| 2,506,308 | 5/1950 | Maynier | 36/94 |
| 2,751,693 | 6/1956 | Baker | 36/11.5 |
| 2,808,662 | 10/1957 | Webb | 36/11.5 |

FOREIGN PATENT DOCUMENTS

| | | | |
|---|---|---|---|
| 25001 | 2/1903 | United Kingdom | 36/11.5 |

*Primary Examiner*—M. D. Patterson
*Attorney, Agent, or Firm*—Price, Heneveld, Cooper, DeWitt & Litton

[57] ABSTRACT

A sandal having first and second strap tabs extending from a strap fixed to the sole of a sandal; the first strap tab is positioned between a big toe and an adjacent toe and the second strap tab is positioned between a little toe and an adjacent toe when a user's foot is inserted between the strap and the sole. The sandal embodying the invention fits well to the user's foot and can be worn while participating in sport activities such as running, walking over rough terrain with ease and comfort.

7 Claims, 4 Drawing Sheets

THONG TYPE SANDAL

BACKGROUND OF THE INVENTION

1. Field of the Invention

The present invention relates to a sandal and particularly, to a thong type sandal where the strap comes up between the big toe and the second toe.

2. Discussion of the Related Art

FIG. 1 generally illustrates a conventional thong-type wherein the numerical reference 1 represents a sole, 2 denotes a strap body, 3 denotes a strap fixture and the, numerical reference 4 indicates strap ends. The strap fixture 3 is fixed to the sole 1 by means of a rivet 5 and both strap ends 4 are also fixed to the sole 1 by, for instance, thermo-compression bonding. The sandal is used in such a manner that the foot is inserted between the sole 1 and the strap body 2 so as to put the strap fixture 3 between the big toe and the second toe.

Such a sandal can be used easily, and since only a small part of the foot makes contact with the sandal, except for the sole of a foot, people can use them with a feeling almost of being in their bare feet. It is well known that such sandals made of material such as from urethane are suitable for use on the hot sand of a summer beach.

However, the sandal described above has a construction such that the foot is fixed to the sole 1 only at the strap fixture 3 between the big toe and the second toe. Therefore, when people using the sandals are walking, their feet often deviate from the proper position on the sole 1 or slip off the sole 1.

In the sandal described above, deviation or slipping is prevented by the portions of the straps near the ends 4 which are fixed to both sides of the sole 1. However, since the sandal is used in such a manner that the instep of a foot is inserted between the sole 1 and the strap body 2 from the rear side, it is required that the strap body 3 be fixed to the sole 1 in a loose condition. Because of the loose condition, occurs when walking. Therefore, it is difficult to wear such a sandal while participating in sports such as beach volley ball or running. It is also dangerous to walk in rocky places or on mountain roads with the sandals. Furthermore, in such a sandal because the toes of the foot are fixed to the sole 1 only by the strap fixture 3, it produces foot fatigue for people who wear the sandals for a long time.

For sports, such as beach volley ball or running, another type of sandal, a so called sports sandal, is generally used, which comprises additional straps to fix the heel and/or the ankle. However, it has been difficult to fit the sandal to the foot because not only the toes, but also the heels and/or the ankles should be fixed with straps.

SUMMARY OF THE INVENTION

The purpose of the present invention is to provide a new thong-type sandal where the foot is well fixed to the sole of the sandal without rotational slipping or misalignment of the foot on the sole. People wearing the sandal can participate in sports such as, beach volley ball, running, etc., with less foot fatigue after prolonged use. Further hallux valgus of the foot, flat feet, and athelete's foot can be prevented due to the construction of the sandal.

In one form of the invention, a thong-type sandal comprises a sole, and at least one strap body fixed to the sole of the sandal at least four locations, such that the strap is positioned between a big toe and an adjacent toe and between a little toe and the toe when a user's foot is inserted between the strap body and the sole. Since the foot of the user is fixed to the sole of the sandal at two points, i.e. a first location between the big toe and the adjacent toe and a second location between the little toe and the adjacent toe, the sole of the user's foot does not slip off or deviate from the sole.

DETAILED DESCRIPTION OF THE PREFERRED EMBODIMENTS

Figure 1:
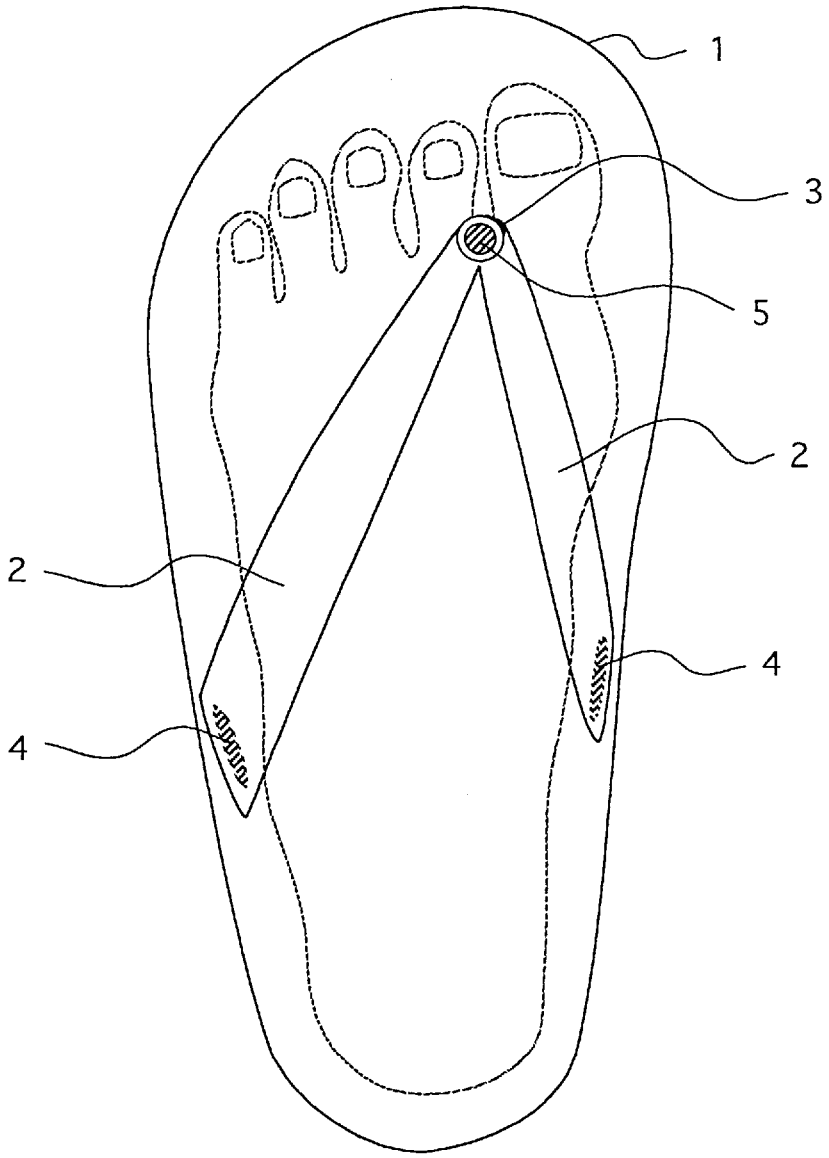
FIG. 1 (Prior Art)
FIG. 1 generally illustrates a conventional thong-type sandal.
Figure 2:
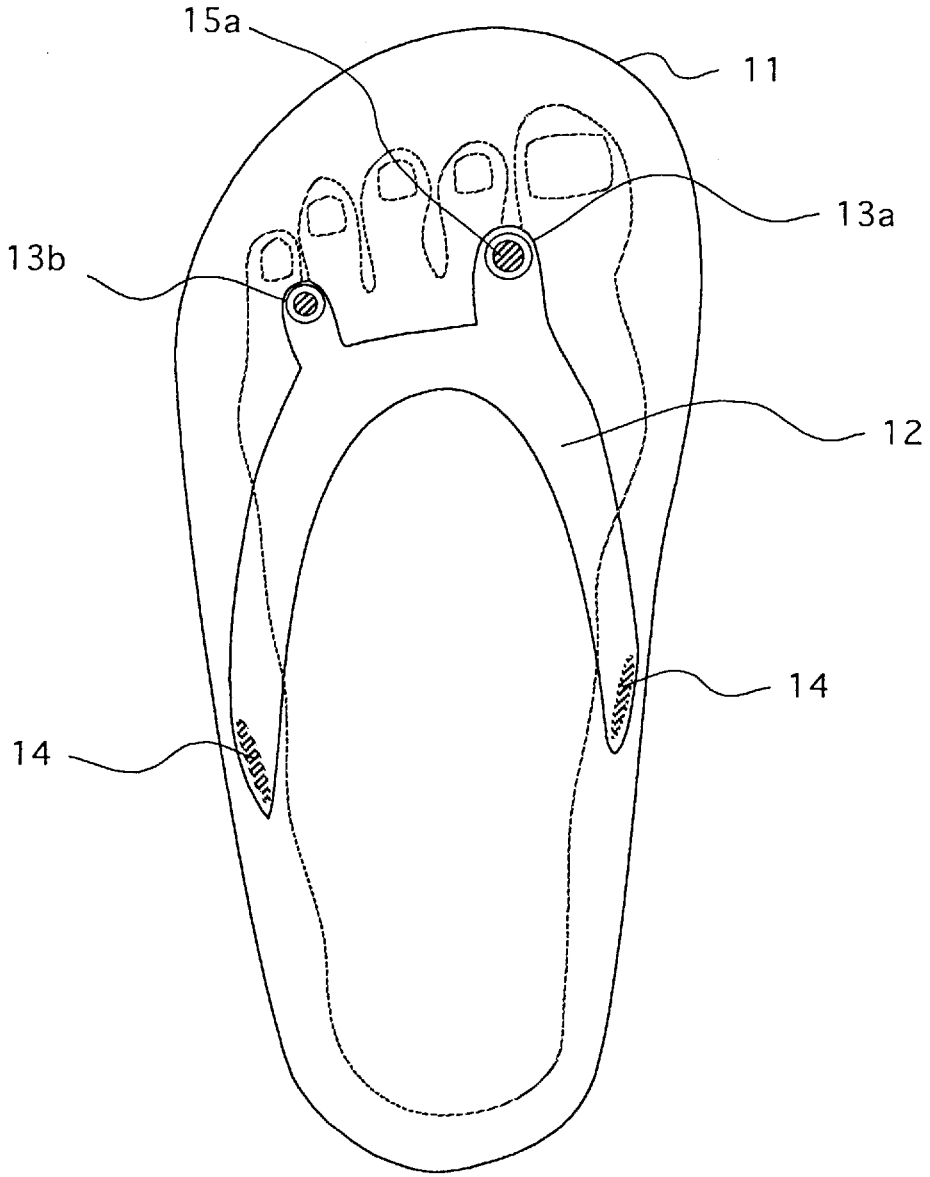
FIG. 2 is a plan view of a thong-type sandal embodying the invention.

With reference to FIG. 2 it should be noted that only one sandal of a symmetric pair is shown. The second sandal of a pair will be substantially a mirror image of that shown herein.

The thong-type sandal 10 (FIG. 2) embodying the invention comprises a sole 11 and a single strap body 12 having a first tab 13*a*, a second tab 13*b*, and strap ends 14 and 16. The first tab 13*a* is fixed to sole 11 by means of a rivet 15*a* at a position where a gap exists between the big toe and the adjacent toe when the foot is inserted between the strap body 12 and the sole 11. The second tab 13*b* is fixed to sole 11 by means of a rivet 15*b* at a position where a gap between the little toe and the adjacent toe exists when the foot is inserted between the strap body 12 and the sole 11. The strap ends 14, 16 are connected to opposite longitudinal sides of the sole 11 preferably by thermocompression bonding.

In studying the spaces between the toes, in general the gap between the big toe and the adjacent or second toe and the gap between the little toe and the adjacent or fourth toe next to it are curved comparatively speaking slightly more than the gaps between the second and third toes and between the third and fourth toes. It has been shown by the inventor's experiments that the second tab 13*b* does not cause any pain or discomfort between the little toe and the adjacent toe and the user becomes comfortable with the sandal in a relatively short period of time. Furthermore, the second strap fixture or tab 13*b* stimulates the gap between the little toe and the adjacent toe such that and the stimulation works to massage an effective spot on the foot.

The inventor's experiments additionally show that a foot can fit to the sole by only fixing the gaps between the big toe and the adjacent toe and between the little toe and the adjacent toe because the distance between the fixing points is sufficient to fix the toe portion of a foot to the sole 11. The fit is such that a user can walk or run in the sandals without any deviation or slipping of the foot on the sole 11. Accordingly, it becomes possible for people to walk or run while wearing the thong-type sandal and can be used to walk on rocky terrain, on mountains or in water, or when participating in sports activities, such as beach volley ball.

The load applied on the toes and calves of each foot is remarkably reduced in comparison with the conventional type thong sandals, so that fatigue on the feet can be reduced even if the user wears sandals for a long time. Furthermore, deformation of the little toes, which is generally caused by tight shoes, can be prevented because the little toe of each foot is stretched outwardly. As a result, hallux valgus, flat sole of feet, and athlete's foot can be prevented.

Figure 3:
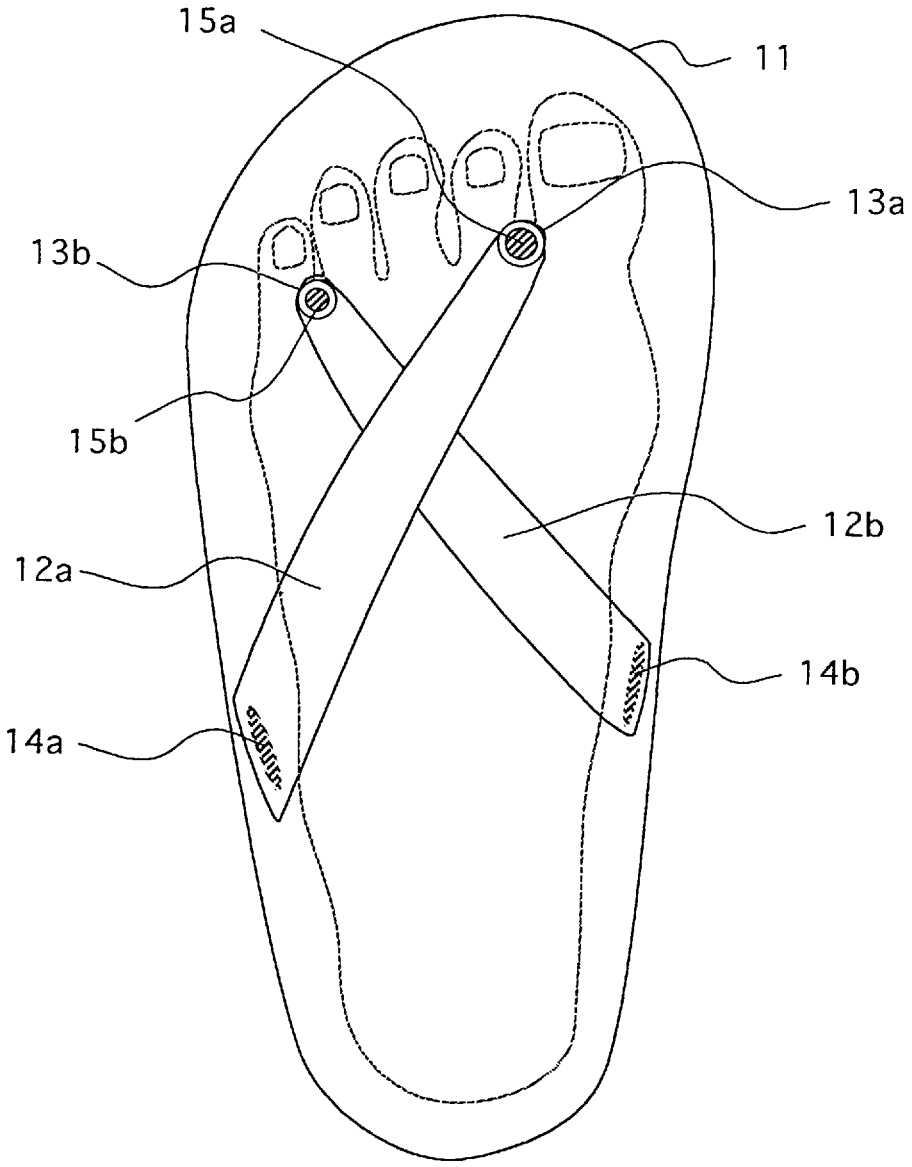
FIG. 3 is a plan view of an alternate embodiment a thong-type sandal of the invention.

FIG. 3 illustrates a second embodiment of the thong-type sandal. It should be noted that in these later embodiments the same reference numbers are used for the same elements as those of the first embodiment. In the second embodiment, the thong-type sandal 10 comprises a first and a second strap 12*a* and 12*b*, respectively, each having a strap fixture 13*a*, 13*b* and a strap end 14*a*, 14*b*. First and second strap fixtures 13*a* and 13*b* are fixed to sole 11 by means of rivets 15*a* and 15*b* while strap ends 14*a* and 14*b* are fixed proximate to opposite longitudinal sides of sole 11. The first strap body 12*a* is crossed over strap body 12*b* at a point above the instep of a user's foot. In the second embodiment, since the strap bodies 12*a* and 12*b* cross each other, the user's foot is supported in a well fitting manner.

Figure 4:
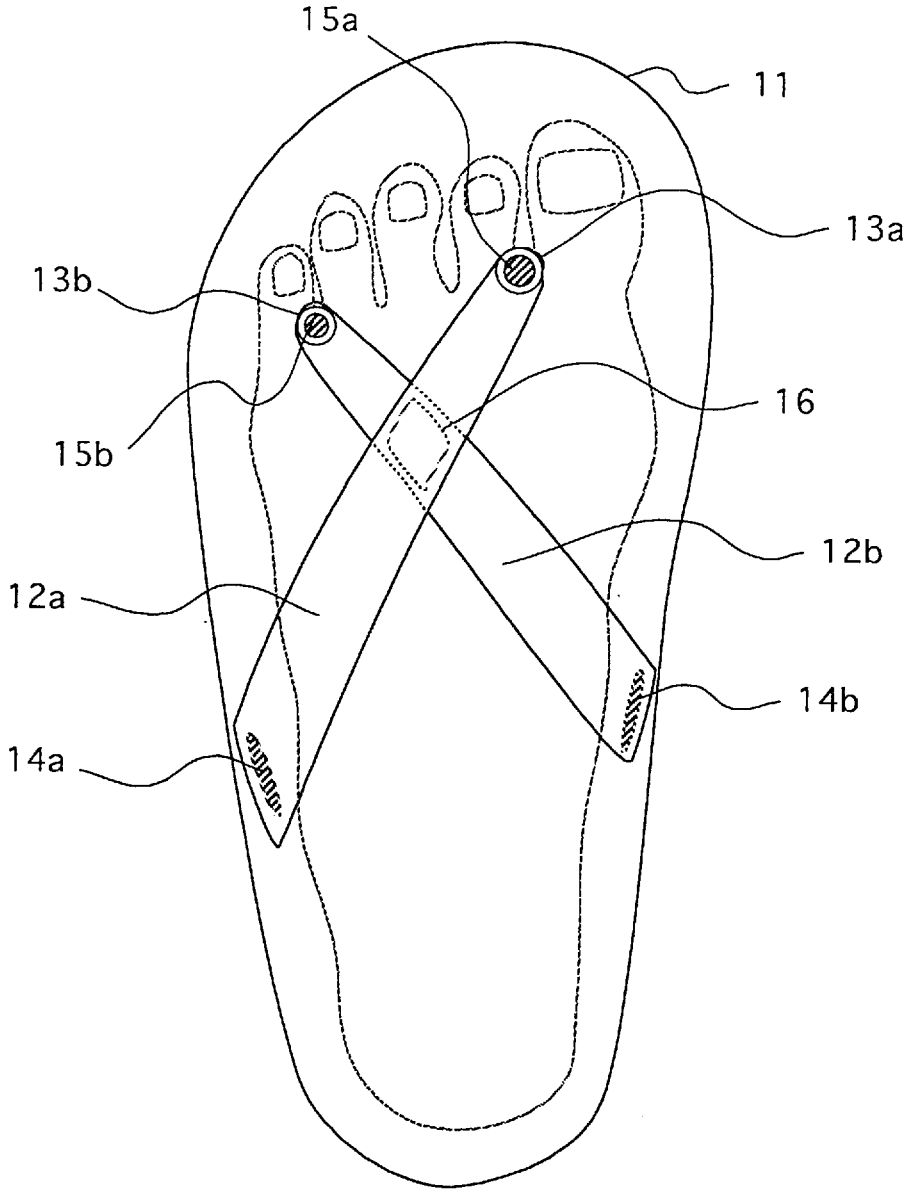
FIG. 4 is a plan view of the thong-type sandal forming a third embodiment of the invention.

FIG. 4 illustrates yet another embodiment of the new thong-type sandal 10. According to this embodiment, the crossing portion 16 of strap body 12*a* and the second strap body 12*b* are connected to each other by means of, for instance, synthetic paste. It should be noted that the means for connecting the first and second straps 12*a* and 12*b* is not limited to synthetic adhesive, but includes among other things, thread mechanical fasteners, such as bolts.

The present invention is not only limited to the different embodiments described above, but also various modifications are to be considered. For instance, any material which can be suitably used for manufacturing the sole 11 and straps 12, 12*a* and 12*b* can be used in the manufacture of the invention. Further, it is contemplated to provide another strap to support the ankle. Furthermore, it is also contemplated to provide relatively small protrusions on the surface of the sole 11 not only to prevent rotational or translational slippage of the foot on the sole, but also to give comfortable stimulus to the sole of the foot.

As described above, the toe portion of the user's foot is fixed with respect to the sole of the sandal at two points, i.e. the first strap fixture 13*a* and the second strap fixture 13*b*, so that the sandal fits well to the foot, preventing misalignment and slipping between the sole of a foot and the sole of the sandal. Therefore, the sandal of this invention offers the advantages of being worn while participating in sports, such as running, walking on a rough road without losing the ease and comfort which are originally possessed in wearing conventional sandals.

The above description is considered that of the preferred embodiments only. Modification of the invention will occur to those skilled in the art and to those who make and use the invention. Therefore, it is understood that the embodiments shown in the drawings and described above are merely for illustrative purposes and are not intended to limit the scope of the invention, which is defined by the following claims.

I claim:

1. A sandal comprising:

a sole; and at least one strap body having first and second strap ends and first and second strap tabs only which are fixed to said sole of the sandal, said first strap tab positioned between a big toe and an adjacent toe, and said second strap tab positioned between a little toe and an adjacent toe when a user's foot is inserted between the strap body and the sole, wherein only said first and second strap tabs are positioned between toes of a user's foot.

2. The sandal as defined in claim 1, wherein said at least one strap body comprises a single strap having said first and second strap tabs provided intermediate said first and second strap ends.

3. The sandal as defined in claim 1, wherein said at least one strap body comprises:

a first strap body crossing over a second strap body, said first strap body having one end fixed proximate to one longitudinal side of said sole of the sandal, and an opposite end fixed to said sole at a point generally below a space between a big toe and an adjacent toe; and said second strap body having a first end fixed proximate to an opposite longitudinal side of said sole of the sandal and an opposite end fixed to said sole at a point below a space generally between a little toe and an adjacent toe.

4. The sandal as defined in claim 3, wherein said first and second strap bodies are connected to each other at a cross-over point of said first and second strap bodies.

5. A sandal comprising:

a sole;

a strap body having first and second strap ends, said first strap end fixed proximate to one longitudinal side of said sole and said second strap end fixed proximate to an opposite longitudinal side of said sole; and first and second strap tabs only provided intermediate said first and second strap ends and fixed to said sole, said first strap tab positioned between a big toe and an adjacent toe and said second strap tab positioned between a little toe and an adjacent toe when a user's foot is inserted between the strap body and the sole, wherein only said first and second strap tabs are positioned between toes of a user's foot.

6. A sandal comprising:

a sole;

a first strap body having one end fixed proximate to one longitudinal side of said sole, and an opposite end fixed to said sole at a point generally below a space provided between a big toe and an adjacent toe of a user's foot;

a second strap body crossing over said first strap body, said second strap body having a first end fixed proximate to an opposite longitudinal side of said sole and an opposite end fixed to said sole at a point below a space generally between a little toe and an adjacent toe of a user's foot; and first and second strap tabs only fixed to said sole of said sandal, said first strap tab positioned between the big toe and the adjacent toe and said second strap tab positioned between the little toe and the adjacent toe when a user's foot is inserted between the first and second strap bodies and the sole, wherein only said first and second strap tabs are positioned between toes of a user's foot.

7. The sandal as defined in claim 6, wherein said first and second strap bodies are connected to each other at a cross-over point of said first and second strap bodies.

* * * * *

UNITED STATES PATENT AND TRADEMARK OFFICE

CERTIFICATE OF CORRECTION

PATENT NO. : 5,802,737
DATED : September 8, 1998
INVENTOR : Shinichi Beppu

It is certified that error appears in the above-identified patent and that said Letters Patent is hereby corrected as shown below:

Column 1, line 24;
Delete "of material such as".

Column 1, line 65;
Insert --at-- before "at".

Column 1, line 67;
Insert --adjacent-- before "toe".

Signed and Sealed this

Sixth Day of April, 1999

*Attest:*

Q. TODD DICKINSON

*Attesting Officer*

*Acting Commissioner of Patents and Trademarks*